US009644297B2

(12) United States Patent
Mathews

(10) Patent No.: US 9,644,297 B2
(45) Date of Patent: May 9, 2017

(54) VARIABLE STROKE DRIVE SYSTEM FOR TUFTING MACHINE

(71) Applicant: Card-Monroe Corp., Chattanooga (Hixson), TN (US)

(72) Inventor: Ricky E. Mathews, Sale Creek, TN (US)

(73) Assignee: Card-Monroe Corp., Chattanooga, TN (US)

( * ) Notice: Subject to any disclaimer, the term of this patent is extended or adjusted under 35 U.S.C. 154(b) by 98 days.

(21) Appl. No.: 14/633,851

(22) Filed: Feb. 27, 2015

(65) Prior Publication Data

US 2015/0247272 A1 Sep. 3, 2015

Related U.S. Application Data

(60) Provisional application No. 61/946,199, filed on Feb. 28, 2014.

(51) Int. Cl.

| | |
|---|---|
| ***D05B 69/10*** | (2006.01) |
| ***D05C 15/32*** | (2006.01) |
| ***D05C 15/00*** | (2006.01) |
| ***D05C 15/12*** | (2006.01) |

(52) U.S. Cl.
CPC ..... *D05B 69/10* (2013.01); *D05C 15/00* (2013.01); *D05C 15/12* (2013.01); *D05C 15/32* (2013.01)

(58) Field of Classification Search
CPC ..... D05C 15/00; D05C 15/08; D05C 15/30; D05C 15/20; B68G 7/08; D05B 69/12; D05B 19/00
USPC ... 112/475.23, 2.2, 80.01, 220, 80.41, 80.43, 112/463, 465
See application file for complete search history.

(56) References Cited

U.S. PATENT DOCUMENTS

| | | | | |
|---|---|---|---|---|
| 3,376,835 | A * | 4/1968 | Watkins | D05C 15/00 112/410 |
| 3,881,432 | A | 5/1975 | Dodd et al. | |
| 3,964,408 | A | 6/1976 | Smith | |
| 4,089,281 | A | 5/1978 | Landoni | |
| 4,109,593 | A | 8/1978 | Barnes et al. | |
| 4,173,192 | A | 11/1979 | Schmidt et al. | |
| 4,187,788 | A * | 2/1980 | Cobble | D05C 15/20 112/254 |
| 4,282,818 | A | 8/1981 | Ingram | |

(Continued)

*Primary Examiner* — Tejash Patel
(74) *Attorney, Agent, or Firm* — Womble Carlyle Sandridge & Rice LLP

(57) ABSTRACT

A variable stroke drive system for a tufting machine includes a series of drive assemblies mounted along the frame of the tufting machine. Primary drive shafts extend through the drive assemblies and are each driven by a drive motor. A series of first drive members are mounted to the primary drive shafts and are linked to associated second drive members such that the driving of the first drive members by the primary drive shafts in turn drives the second drive members. Cam arms are connected to the second drive members and to rocker arms to which push rods are mounted, the cam arms being vertically reciprocated by the rotational movement of the second drive members so as to drive the reciprocation of the push rods, and thus the needle bar(s) connected thereto along a desired stroke or reciprocating path of travel. Controlling the rate at which the primary drive shafts are driven enables control of the stroke of the needle bar(s).

20 Claims, 5 Drawing Sheets

(56) References Cited

U.S. PATENT DOCUMENTS

| | | | | | |
|---|---|---|---|---|---|
| 4,366,761 | A * | 1/1983 | Card | D05C 15/30 | 112/80.23 |
| 4,398,479 | A * | 8/1983 | Czelusniak, Jr. | D05C 15/30 | 112/475.23 |
| 4,419,944 | A | 12/1983 | Passons et al. | | |
| 4,445,447 | A | 5/1984 | Bardsley et al. | | |
| 4,465,001 | A | 8/1984 | Ingram | | |
| 4,586,445 | A | 5/1986 | Card et al. | | |
| 4,597,344 | A | 7/1986 | Stutznäcker | | |
| 4,653,293 | A | 3/1987 | Porat | | |
| 4,653,413 | A | 3/1987 | Bagnall | | |
| 4,815,401 | A | 3/1989 | Bagnall | | |
| 4,829,917 | A | 5/1989 | Morgante et al. | | |
| 4,867,080 | A | 9/1989 | Taylor et al. | | |
| 5,392,723 | A | 2/1995 | Kaju | | |
| 5,513,586 | A | 5/1996 | Neely et al. | | |
| 5,526,760 | A | 6/1996 | Ok | | |
| 5,555,826 | A | 9/1996 | Satterfield | | |
| 5,572,939 | A | 11/1996 | Beatty | | |
| 5,575,228 | A | 11/1996 | Padgett et al. | | |
| 5,706,745 | A | 1/1998 | Neely et al. | | |
| 5,794,551 | A | 8/1998 | Morrison et al. | | |
| 5,857,422 | A | 1/1999 | Neely et al. | | |
| 5,979,344 | A | 11/1999 | Christman, Jr. | | |
| 6,283,052 | B1 | 9/2001 | Pratt | | |
| 6,401,639 | B1 | 6/2002 | Samilo | | |
| 6,827,030 | B2 | 12/2004 | Hicks | | |
| 6,877,447 | B2 * | 4/2005 | Frost | D05C 15/32 | 112/475.23 |
| 6,920,837 | B2 | 7/2005 | Keilmann | | |
| 6,945,183 | B2 * | 9/2005 | Card | D05C 15/34 | 112/475.23 |
| 6,971,326 | B1 | 12/2005 | Clarke et al. | | |
| 7,578,249 | B2 | 8/2009 | Morgante et al. | | |
| 7,836,836 | B2 | 11/2010 | Brewer | | |
| 8,671,858 | B2 | 3/2014 | Morgante et al. | | |
| 2014/0260797 | A1 | 9/2014 | Maddox | | |

* cited by examiner

VARIABLE STROKE DRIVE SYSTEM FOR TUFTING MACHINE

CROSS REFERENCE TO RELATED APPLICATIONS

The present Patent Application is a formalization of previously filed, U.S. Provisional Patent Application Ser. No. 61/946,199, filed Feb. 28, 2014 and by the inventor named in the present Application. This Patent Application claims the benefit of the filing date of the cited Provisional Patent Application according to the statutes and rules governing provisional patent applications, particularly 35 U.S.C. §119(e), and 37 C.F.R. §§1.78(a)(3) and 1.78(a)(4). The specification and drawings of the Provisional Patent Application referenced above are specifically incorporated herein by reference as if set forth in their entirety.

FIELD OF THE INVENTION

The present invention relates in general to tufting systems, and in particular to a variable stroke drive system for driving a needle bar of a tufting machine.

BACKGROUND OF THE INVENTION

Tufting machines or similar systems for producing tufted articles such as carpets generally include one or more needle bars having a series of needles arranged in spaced series along their length. The needle bars typically are driven in a vertically reciprocating fashion by the operation of a main driveshaft of the tufting machine. As the main driveshaft is rotated, it drives a series of push rods linked thereto and which are connected to the needle bars. The needles carried by the needle bars thus are moved along a vertically reciprocating path or stroke into and out of a backing material passing through a tufting zone of the tufting machine. As the needles penetrate the backing material, each of the needles will carry a yarn therethrough and will be engaged by a loop pile looper, cut pile hook, level cut loop (LCL) looper, etc., so as to pick up and capture loops of yarns from the needles. Where cut pile hooks and/or LCL loopers are used, a series of knives further can be reciprocated into engagement with the cut pile hooks or LCL loopers so as to sever the loops of yarns captured thereon to form cut pile tufts.

When setting up a tufting machine, and further when changing styles or patterns of carpets being produced by the tufting machine, it can be necessary to change the stroke or amount of travel of the needles into and out of the backing material such as for adjustment of pile heights or other pattern effects. In addition, it also can be desirable to control the stroke or movement of the needles to provide for shorter or longer upstrokes of the needles such as to provide for increased dwell time that the needles remain out of the backing material during shifting of the needle bars. In the past, shims have been added as needed to adjust or change the position or elevation of the needles during changeovers and during initial set-up of a tufting machine to properly position the needles for a desired stroke. Adding such shims is, however, time consuming, requiring increased initial set-up time and labor for the set-up of the tufting machine, as well as during style/pattern change-overs, and requires the tufting machine to be shut down as these shims are added. The use of such shims further can limit the amount of adjustment provided.

Accordingly, it can be seen that a need exists for a system and method for variably driving the stroke of one or more needle bars in a tufting machine which addresses the foregoing and other related and unrelated problems in the art.

SUMMARY OF THE INVENTION

Briefly described, the present invention comprises a variable drive system for a tufting machine for driving one or more needle bars of the tufting machine along a vertically reciprocating motion or stroke. The stroke of the one or more needle bars can be varied by the variable drive system, including adjusting or varying the stroke or movement of the one or more needle bars during individual stitch cycles of the tufting machine, typically without requiring a shut down of the tufting machine, and without requiring the addition of shims or other physical adjustments of the needle bars, to change patterns or styles of tufted fabrics being produced.

The tufting machine generally will comprise a frame having a base and head portion, with a tufting zone being defined therebetween, and a backing material being fed through the tufting zone by a series of backing feed rolls. One or more yarn feed mechanisms further can be arranged along the front and/or rear or upstream and/or downstream sides of the tufting machine for feeding a series of yarns to each of a series of needles mounted in spaced series along the one or more needle bars. The one or more yarn feed mechanisms can include standard yarn feed devices or attachments as well as other yarn feed systems or pattern attachments, including single-end, double-end, scroll, roll and other attachments. The feeding of the yarns to the needles by the one or more yarn feed mechanisms, as well as the feeding of the backing material through the tufting zone also can be controlled by a tufting machine controller. Still further, the one or more needle bars can be linked to a shift mechanism such as a cam shifter or a SmartStep™ needle bar shift mechanism such as produced by Card-Monroe Corp., for shifting the one or more needle bars transversely with respect to the backing material moving through the tufting zone.

The variable drive system generally can be mounted along the frame of the tufting machine, and will control the driving of the one or more needle bars along their vertically reciprocating stroke or path of movement through the tufting zone. In one embodiment, the variable drive system can include a series of drive assemblies mounted at spaced locations across the head portion of the tufting machine. A set of first or primary driveshafts can extend through one or more of the drive assemblies, in one embodiment, extending across the tufting machine frame, through each of the spaced drive assemblies, and with a first end of each primary driveshaft being connected to its drive motor. In an additional embodiment, both ends of the primary driveshafts can be linked or connected to a drive motor, with the drive motors being linked to and controlled by the tufting machine controller so as to be driven in a cooperative, synchronized relationship. Still further, the primary driveshafts can include or be formed in sections, for example, including a first pair or series of primary driveshafts extending from one side of the tufting machine through a portion or series of the drive assemblies and being connected to a first pair of drive motors, and a second pair or series of primary driveshafts connected to a second pair of drive motors and extending from the opposite direction through a portion or series of the drive assemblies, and with the two sets of primary driveshafts generally being linked and/or driven in synchronized operation.

Each of the drive assemblies generally can include a first or upper set or pair of drive members or gears, each mounted along one of the primary driveshafts, and a set or pair of second or lower drive members or gears mounted along one of a pair of secondary driveshafts. The first and second drive members also generally will be linked together by drive belts or chains such that the second drive members are rotatably driven by the rotation of their associated first drive members by the primary driveshafts. Cam arms additionally will be mounted to each of the second drive members, the cam arms each generally having a first or proximal end engaging a cam bushing. As the second or lower drive members are rotated, the cam arms are caused to move in a substantially linear, vertically reciprocating manner. The opposite, distal ends of the cam arms in turn, can be mounted to opposite ends of a rocker arm extending therebetween.

As the cam arms are reciprocated vertically with the rotation of the second or lower drive members, they push or pull the rocker arm, so as to impart a corresponding substantially linear or vertically reciprocating motion thereto. A push rod will be mounted to each rocker arm, a first end of each push rod typically being pivotally mounted intermediate the opposite ends of its rocker arm, with a second end of each push rod connected to the one or more needle bars. As a result, the push rods translate or impart the substantially linear or vertically reciprocating motion of their associated cam arms and rocker arm to the one or more needle bars, so as to drive the one or more needle bars along their vertically reciprocating stroke or path of travel toward and away from the backing material so that their needles penetrate the backing material for formation of tufts of yarns therein.

The drive motors driving the primary driveshafts, in one embodiment, can be driven in a phased relationship such that the cam arms will be moved along a vertically reciprocating path of movement that is substantially equivalent or parallel. In such an embodiment, the cam arms will urge their rocker arms, and thus the push rods connected thereto, downwardly and upwardly in a substantially synchronized movement to reciprocate a needle bar or bars along a desired stroke path and/or length/distance. To vary the stroke of the needle bar(s), such as to increase the length of the down stroke and/or depth of penetration of the needles, or to increase the upstroke of the needles, the drive motors can be operated at different rates, thus driving each associated set or linked pair of first and second drive members at different rates so as to cause the cam arms to be vertically reciprocated in an out-of-phase relationship or operation. As a result, the rocker arms mounted therebetween will be caused to be pivoted with respect to their push rods so that the distance or amount of vertical travel of the rocker arms that is imported to their push rods, and thus the stroke or travel of the needle bar(s) can be varied.

The needle bar(s) further can be driven along their upstroke and/or downstroke at faster or different rates as needled to complete the desired stroke within each stitch cycle. For example, during a stroke of the needle bar(s), the operation of the drive motors can be varied at one or more desired points during the stroke so as to create a deeper penetration depth of the needles, or conversely a longer upstroke of the needle bar(s) to provide a delay or longer dwell time of the needles out of the backing material, such as when the needles are at their highest elevation out of the backing material, to enable shifting of the needles without interference or engagement with the backing material. Thereafter, the drive motors can be operated to drive the vertical movement of the needle bar(s) at a desired rate needed to complete the stitch cycle. Thus, the variable drive system can enable adjustments of the stroke on the fly or otherwise during operation of the tufting machine.

Various features, objects and advantages of the present invention will become apparent to those skilled in the art upon a review of the following detailed description, when taken in conjunction with the accompanying drawings.

Figure 1:
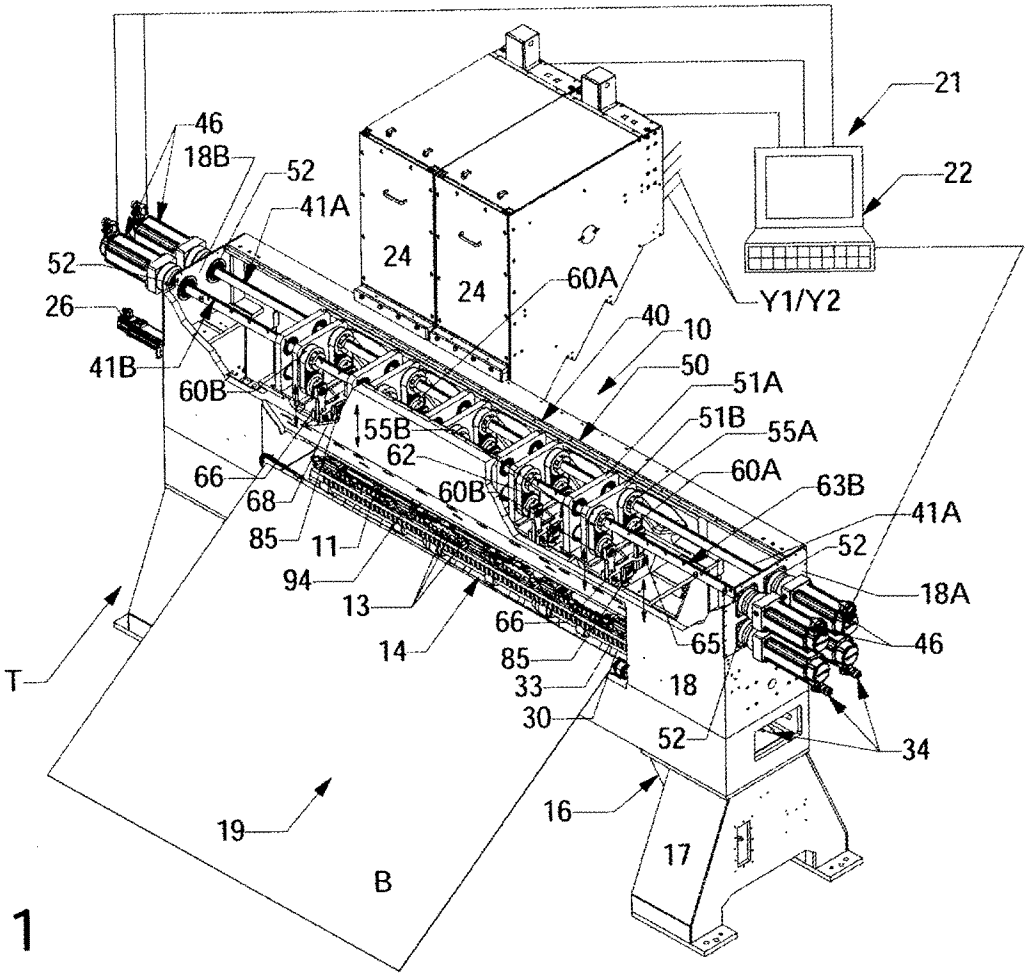
FIG. 1 is a perspective illustration of the tufting machine including one example embodiment of the variable drive system incorporating the features of the present invention.

The embodiments of the invention and the various features thereof are explained below in detail with reference to non-limiting embodiments and examples that are described and/or illustrated in the accompanying drawings. It should be noted that the features illustrated in the drawings are not necessarily drawn to scale, and features of one embodiment may be employed with other embodiments as the skilled artisan would recognize, even if not explicitly stated herein. Descriptions of certain components and processing techniques may be omitted so as to not unnecessarily obscure the embodiments and/or features of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law.

Those skilled in the art will appreciate and understand that, according to common practice, the various features of the drawings discussed below are not necessarily drawn to scale, and that the dimensions of various features and elements of the drawings may be expanded or reduced to more clearly illustrate the embodiments of the present invention described herein.

DETAILED DESCRIPTION OF THE INVENTION

Referring now to the drawings in greater detail in which like numerals indicate like parts throughout the several views, FIGS. 1-3B illustrate embodiments of a variable stroke drive system 10 according to the principles of the present invention. The variable stroke drive system 10 is operable for driving one or more needle bars 11 of a tufting machine T in a vertically reciprocating motion or stroke, as indicated by arrows 12 and 12' in FIG. 2A, so as to drive the reciprocation of a series of needles 13 mounted along the one or more needle bars 11 into and out of a backing material B moving through a tufting zone 14 (FIG. 1) of the tufting machine T. The variable stroke drive system 10 provides for enhanced control of the stroke or vertically reciprocating movement of the one or more needle bars, so as to enable adjustment of the stroke of the one or more needle bars, including controlling or varying the upstroke and/or downstroke of the one or more needle bars during individual tuft or stitch cycles of the tufting machine, without requiring the use of shims or other physical mechanisms to adjust the position of the needles or needle bar(s) to vary the stroke of the one or more needle bars. As a further result, the stroke control and adjustment provided by the variable stroke drive system 10 thus can help reduce labor and time required for initial setup of the tufting machine, as well as during later changes in styles or patterns and/or pattern effects of tufted articles, such as carpets, being produced.

As illustrated in FIG. 1, the tufting machine T generally will include a tufting machine frame 16 having a base 17 and a head or upper portion 18, with the tufting zone 14 being defined therebetween. The backing material B generally will be fed through the tufting zone 14 of the tufting machine, as indicated by arrow 19, with the backing material generally being fed along its path of travel 19 at an effective stitch rate by a series of backing feed rolls under control of a tufting machine controller 21.

The tufting machine controller 21, in one embodiment, can include a Command Performance™ tufting machine control system as manufactured by Card-Monroe Corp. In one example embodiment, the tufting machine controller 21 can include an operator interface 22, such as a touch screen, monitor with a keyboard and/or mouse, and/or other, similar interface through which the operator can input and/or adjust various operating parameters for the tufting machine, such as backing feed rates, yarn feed and other pattern information for the article being formed. The tufting machine controller further can be linked to a server, design center or other machine control systems, and will monitor and control the various operative elements of the tufting machine.

Figure 2A:
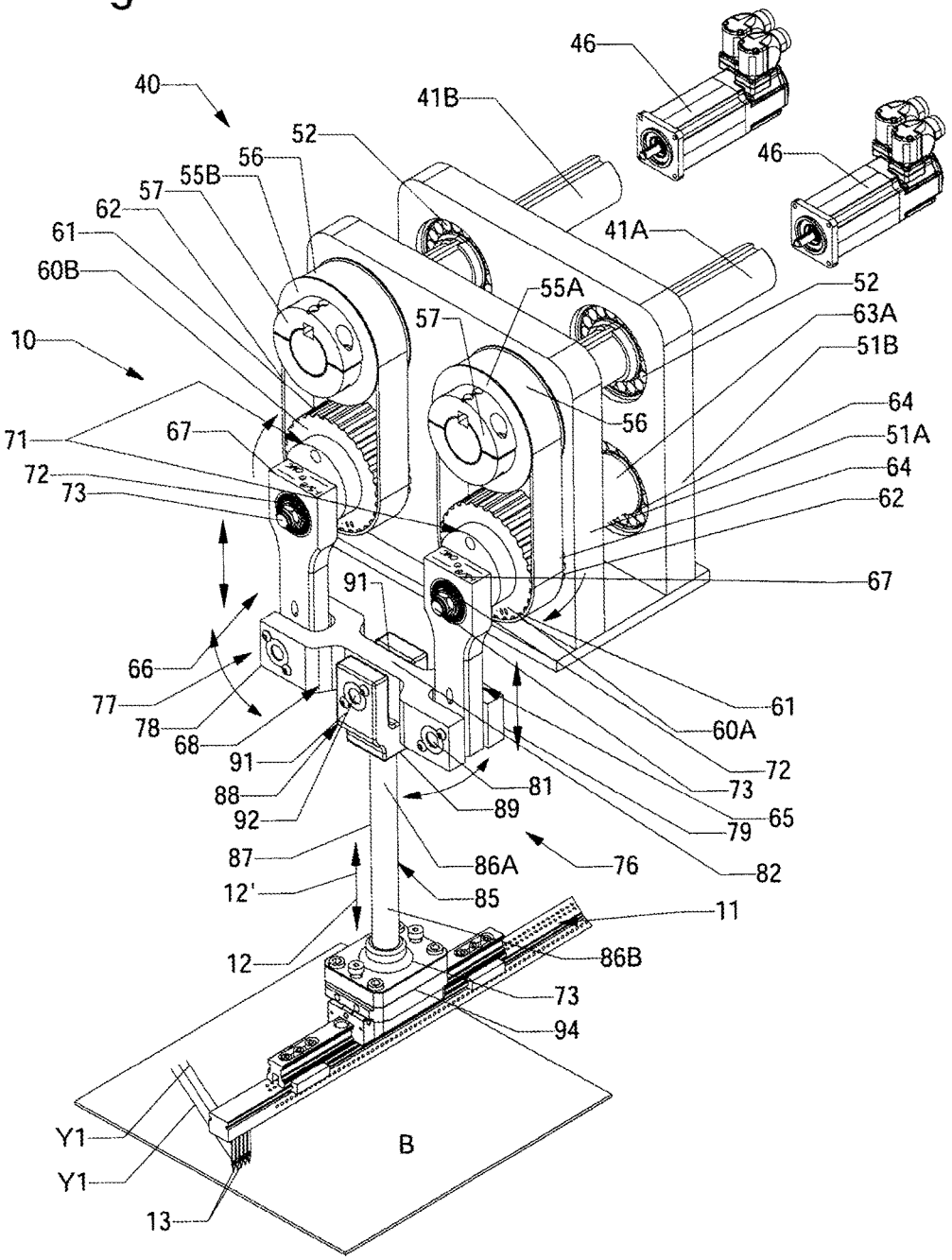
FIG. 2A is a perspective illustration schematically illustrating one embodiment of the variable drive system according to the principles of the present invention.
Figure 2B:
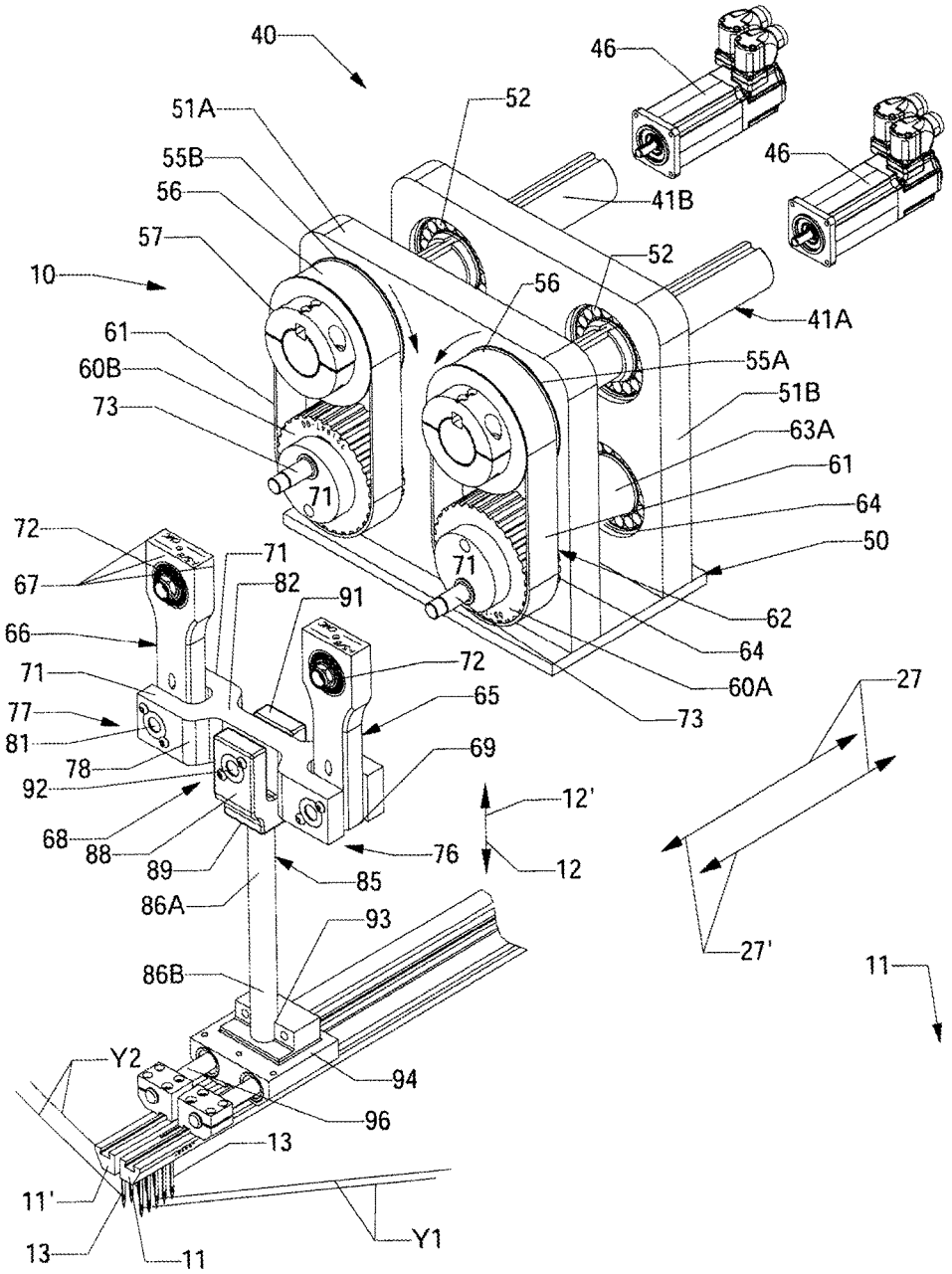
FIG. 2B is an exploded perspective illustration illustrating the variable drive system incorporating the features of the present invention, and illustrating its use with a pair of shiftable needle bars.

In addition, as also shown in FIG. 1, one or more yarn feed mechanisms 24 can be mounted to the tufting machine frame 16, for feeding a series of yarns to the needles, such as indicated at Y1 in FIG. 2A, and at Y1 and Y2 in FIG. 2B. The one or more yarn feed mechanisms can include standard or conventional yarn feed mechanisms having a series of yarn feed rolls that receive yarns from a yarn supply or creel. Alternatively, the one or more yarn feed mechanisms can include various yarn feed pattern attachments or devices such as a scroll, roll, single or double end yarn feed attachments, for example including an Infinity™, Infinity IIE™, and/or Yarntronics™ pattern attachments/yarn feed systems as manufactured by Card-Monroe Corp. The yarn feed mechanisms further can be mounted on the same or on opposite sides of the tufting machine, i.e., on an upstream or downstream side thereof. The yarn feed mechanisms can control the feeding of the yarns to each of the needles 13 mounted along the one or more needle bars 11, including varying the yarn feed in accordance with pattern instructions as received at or programmed into the tufting machine control system 21 (FIG. 1). Thus, as the needles are reciprocated into and out of the backing material, the yarn feed mechanisms will feed desired amounts of yarns to the needles in accordance with the program pattern instructions to form a desired tufted pattern.

As additionally indicated in FIG. 1, the tufting machine further can include a needle bar shift mechanism 26, such as a Smart Step™ shift mechanism, as manufactured by Card-Monroe Corp., a cam shifter, or other, similar shift mechanism for shifting the one or more needle bars 11/11' transversely across the tufting zone in the direction of arrows 27 and 27' (as indicated in FIG. 2B. The shift mechanism generally will be connected to and operated under control of the tufting machine control system 21 (FIG. 1) in accordance with program pattern instructions as needed for shifting the needle bar, as needed, such as for forming shifted, graphic style patterns.

As illustrated in FIGS. 2A and 2B, the tufting machine can include a single needle bar 11 (FIG. 2A) or two or more needle bars 11/11' (FIG. 2B), which needle bar or needle bars can further be transversely shiftable across the tufting zone. Each needle bar 11 will include a series of needles 13 mounted therealong in a transversely spaced relationship, with the needles generally being mounted at a desired gauge spacing or other, similar spacings. It further will be understood by those skilled in the art that while a single row of needles has been shown mounted on a single needle bar or on each of a pair of needle bars, it is also possible to mount multiple rows of needles along each of the one or more needle bars. In addition, where multiple rows of needles are provided, either on a single needle bar or on multiple needle bars, the needles of each of the rows of needles can be arranged substantially in-line, or can be mounted at an offset or a staggered configuration as needed for forming a desired tufted article.

Figure 3A:
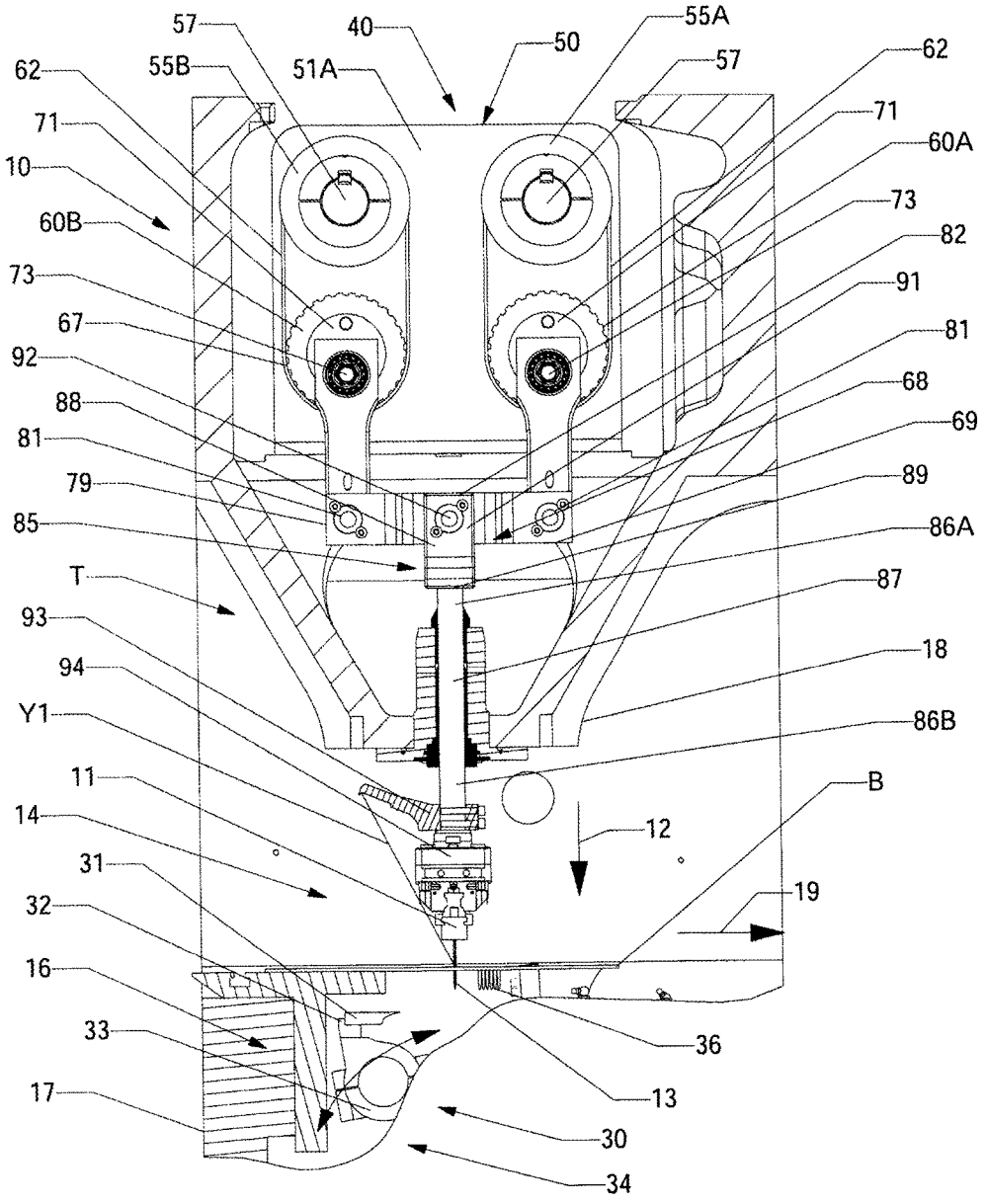
FIGS. 3A and 3B are side elevational views schematically illustrating the operation of the variable drive system of FIGS. 1-2B.
Figure 3B:
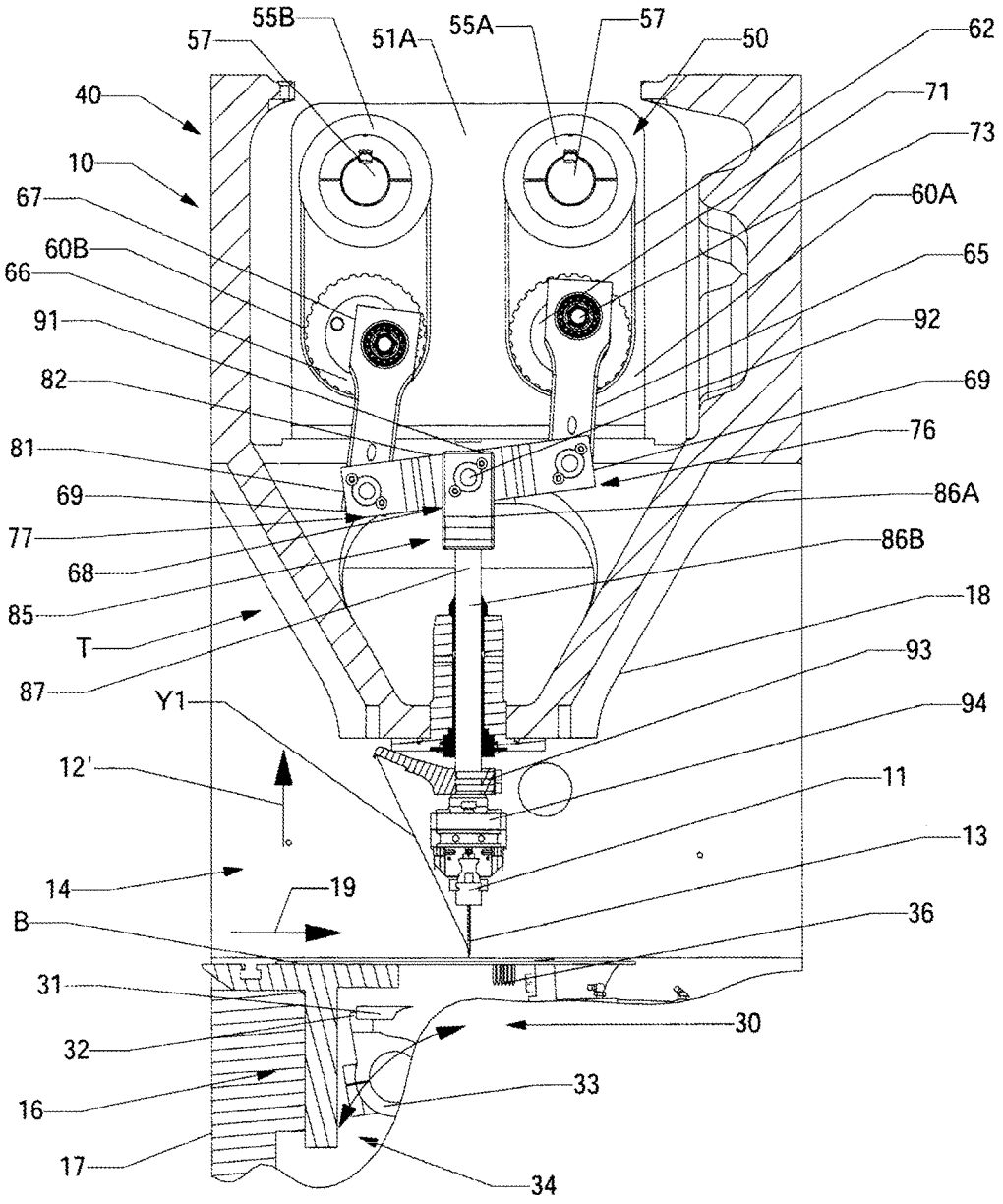

As illustrated in FIGS. 3A and 3B, as the needles penetrate the backing material and are reciprocated to a desired penetration depth, the needles generally will be engaged by a series of gauge parts 30 mounted below the backing material and arranged along one or both sides of the tufting zone 14. The gauge parts can include any of a variety of gauge parts, including loop pile loopers 31, such as shown in FIGS. 3A and 3B. Other types of gauge parts including cut pile hooks, level cut loop loopers, cut loop clips, or and/other gauge parts also can be used. Thus, while loop pile loopers are shown in use on one example embodiment, the present disclosure is not limited to the use of only one type of gauge parts, as will be understood by those skilled in the art.

The gauge parts 30 (such as the loop pile loopers 31 shown in FIGS. 3A and 3B) generally will be mounted to a support bar 32 mounted on an arm 33 of a reciprocating drive mechanism 34 so as to cause the gauge parts to be reciprocated toward and away from the needles as the needles penetrate the backing material, whereupon the gauge parts can engage and pick loops of yarns from the needles for forming a series of tufts, such as loop pile tufts indicated at 36 in FIGS. 3A and 3B, in the backing material B. Where cut pile hooks, cut loop clips, level cut loop loopers or other, similar gauge parts used, a series of knives further can be reciprocated into engagement with such gauge parts to sever the loops of yarns captured thereon and form cut pile tufts as will be understood by those skilled in the art.

As illustrated in FIG. 1, the variable stroke drive system 10 can include a series of drive assemblies 40 mounted at spaced locations along the head portion 18 of the tufting machine frame 16, with a set of first or primary driveshafts, indicated at 41A and 41B in FIG. 1, generally will extend through one or more of the drive assemblies 40. The primary driveshafts, in one embodiment, can include a pair of spaced parallel driveshafts that extend from a first or proximal end 42 substantially across the width of the tufting machine to a distal or second end 43 with the proximal and distal ends 42 and 43 of the primary driveshafts generally being rotatably received through bushings 44 mounted in end plates 18A/18B of the head portion 18 of the tufting machine frame. Each of the primary driveshafts 41A and 41B will be connected to a drive motor 46. The drive motors can include variable speed reversible motors, such as servometers, stepper motors, or other, similar types of motors.

In one embodiment, a pair of drive motors 46 can be connected to one end, i.e., to either the proximal or distal end 42 or 43 of each of the primary driveshafts, and with the primary driveshafts accordingly being rotatably driven by operation of their respective drive motors. In other embodiments, pairs of drive motors 46 can be provided at opposite ends of the tufting machine frame, with a drive motor being linked or connected to each of the proximal and distal ends 42 and 43 of each of the primary driveshafts 41A and 41B, as illustrated in FIG. 1. Each of the drive motors also will be linked to the tufting machine control system 21 so as to provide feedback to and to receive control instructions from tufting the machine control system for driving the primary driveshafts at desired rates in accordance with the pattern instructions for the tufted article being produced. For example, the motors can include servo or stepper motors, or other, similar motors having internal controls or measuring devices to provide feedback information to the control system as to the position of the drive shafts during each revolution thereof. Encoders or other position sensing devices also can be used. In addition, where pairs of drive motors are used to drive the primary driveshafts 41A/41B from each of their opposite ends, the tufting machine control system can coordinate and synchronize the operation of the drive motors for each of the primary driveshafts 41A and 41B so as to drive their primary driveshafts at a consistent rate.

As a further alternative, the primary driveshafts 41A and 41B can be formed in sections or as multiple driveshafts, which can be linked via connecting bushings between each of the drive assemblies 40. For example, the primary driveshafts can include two pairs of driveshafts that extend through multiple ones of the drive assemblies from opposite directions, and are linked at an intermediate point across the width of the tufting machine. Alternatively, the driveshafts can be formed in multiple sections, each extending through one or more drive assemblies, with the multiple driveshaft sections being operatively connected together, such as by bushings or other connectors in between the drive assemblies 40. Still further, additional motors, such as shown at 47 in FIG. 1, can be used to drive other components of the tufting machine, such as gauge driving parts 30 in synchronized fashion with the needles.

As shown in FIGS. 2A and 2B, each of the drive assemblies 40 generally will include a frame or housing 50, in one embodiment shown as including a pair of parallel plates 51 with the primary driveshafts 41A and 41B generally extending through upper portions thereof and being rotatably supported by bushings 52. A set of upper, first or primary drive members 55A and 55B, such as a pair of sprockets or gears, each having a series of teeth 56 formed thereabout, will be mounted along the primary driveshafts 41A and 41B. The first drive members 55A/55B generally will be fixedly mounted to their respective primary driveshafts, for example, in one embodiment including a locking collar or similar connector 59 for securing the drive members at a desired location or position along their primary driveshafts. As a result, as the primary driveshafts are driven by their drive motors, the upper or first drive members 55A/B will be correspondingly driven or rotated with the rotation of the primary driveshafts 41A/41B on which they are mounted.

As further shown in FIGS. 2A-3B, a set of lower or second drive members 60A and 60B generally are mounted below and in a substantially parallel alignment with the first drive members 55A/55B. The second drive members 60A/60B generally will similarly include a pair or series of gears or sprockets having a series of teeth 61 formed thereabout. Drive belts, chains or similar connecting members 62 will be received about each associated pair of first and second drive members, i.e., including a first drive belt 62 extending about first drive member 55A and its associated second drive member 60A, and a second drive belt 62 extending about first drive member 55B and its associated second drive member 60B. As a result, the first and second drive members are each linked together in a driving relationship so that the rotation of each of the first drive members 55A or 55B correspondingly drives their associated second drive members 60A or 60B. Each of the second drive members 60A and 60B further is mounted on and supported by a secondary driveshaft 63, which can be received through the plates 51A/51B of the frame of drive assemblies, generally being supported by bushings 64 to enable rotation of the second drive members 60A/60B in response to rotation of their associated first drive members 55A/55B by the primary driveshafts 41A and 41B.

Each of the drive assemblies 40 further will include a pair of cam arms 65 and 66, each connected at an upper or proximal end 67 to one of the second drive members. The cam arms 65 and 66 further are each pivotally connected to a rocker arm 68 mounted between the lower or distal ends 69 thereof. As indicated in FIGS. 2A and 2B, the first or upper end 67 of each cam arm 65 and 66 generally can be mounted to a cam plate 71 that is attached to its associated second drive member 60A or 60B, or which can be mounted to an end of one of the secondary drive shafts 63. For example, the first or proximal ends of the cam arms can include bushings or other pivotable mounting mechanisms 72 in which cam pins or other fasteners 73 mounted on the cam plates 71 can be received to secure the proximal or first ends of the cam arms to their respective second drive members or secondary drive shafts. As a result, as the second drive members are rotated, the cammed mounting of the cam arms causes the cam arms to be moved along a substantially vertical or elliptical path of travel reciprocating in the direction of arrows 74 and 74', as shown in FIG. 2A.

As further illustrated in FIGS. 2A-3B, the lower or distal ends 69 of each of the cam arms 65 and 66 can be pivotally attached to the opposite, first and second ends 76 and 77 of the rocker arm 68. In one embodiment, the first and second ends 76/77 of the rocker arms can be formed with substantially U- or C-shaped yokes 78, wherein the cam arms can be received between the sides or fingers 79 of the yokes 78 and pivotally secured thereto by fasteners 81, such as pins, bolts, screws, etc. Each rocker arm further generally will be pivotally mounted along an intermediate point or portion 82 thereof to a push rod 85. Each push rod can generally have a construction similar to a conventional push rod, as will be understood by those skilled in the art. For example, each push rod can be formed as a substantially elongated rod 86, including being formed in two or more sections, such as shown at 86A and 86B in FIGS. 3A and 3B, which can be connected by fastener 87 so as to enable longitudinal adjustment of each push rod as understood by those skilled in the art. Each push rod 85 further can include a yoke 88 or similar structure at an upper end 89 thereof, which yoke can receive rocker arm 68 between the fingers or sides 91 thereof. A fastener 92, such as a pin, rivet, screw, bolt, etc., generally will be received through the sides of the yoke at the upper end of each push rod to pivotally attach the rocker arm received therein. As a result, the rocker arm is able to pivot about the connection between the rocker arm and push rod as needed in response to the vertically reciprocating movements of each of the cam arms 65 and 66.

As further illustrated in FIGS. 2A-3B, the lower end 93 of each push rod 85 generally will be connected to the one or more needle bars for driving the vertically reciprocating movement or stroke of the needle bar(s). In one embodiment, the push rods can include a foot or similar connector 94 to attach the one or more needle bars to the push rods. As also illustrated in FIG. 2B, in other embodiments, the one or more needle bars 11/11' can include shiftable needle bars that are linked to a tufting machine shift mechanism 26 (FIG. 1) for transversely shifting the needles across the backing material and across the tufting zone. Where such shiftable needle bars are used, the needle bars can be mounted on slides or rods 96 that are slidably received through the feet or connectors 94 of the push rods. As a result, the needle bars can move along their desired stroke or vertically reciprocating path of travel while at the same time being able to be shifted transversely or laterally in the direction of arrows 27 and 27'.

In operation of the variable stroke drive system 10 according to the principles of the present invention, the primary driveshafts 41A and 41B will be driven by their respective drive motors 46. As the primary driveshafts are rotated, the first drive members 55A and 55B of each of the drive assemblies 40 likewise will be driven or rotated with the rotation of the primary driveshafts. The connecting belts 62 between each associated set of the first and second drive members 55A/60A and 55B/60B in turn will cause the rotation of the second drive members 60A and 60B at a rate generally equivalent to the rate at which their associated first drive members are rotated. As the second or lower drive members 60A and 60B are rotated, the cam arms 65 and 66, which generally are mounted to the second drive members in a cammed or offset mounting, accordingly will be caused to be driven in a vertically reciprocating manner or motion, as indicated by arrows 74/74' in FIG. 2A.

When the drive motors are generally driven at substantially the same or equivalent speed or rate, such that each of the first and second sets of drive members are driven in a synchronized fashion at substantially the same rate, the cam arms 65/66 generally can be moved along a substantially similar, in-phase or synchronized vertically substantially linear, reciprocating motion or path of travel. As a result, the cam arms will push down and pull up on the opposite ends of each of their connected rocker arms in a generally synchronized fashion. This substantially linear, vertically reciprocating motion will be imparted to the push rods connected to each of the rocker arms, which in turn will translate or impart this motion to the one or more needle bars of the tufting machine. Accordingly, by operating the drive motors in a substantially synchronized fashion, the resultant stroke of the needle bar, and thus the penetration of the needles into and out of the backing material, generally will be substantially consistent along its path of travel.

In order to vary or change the stroke of the needle bar, the drive motors can be operated at different rates so as to correspondingly drive the linked or associated sets of first and second or upper and lower drive members 55A/60A and 55B/60B at different rates. This will cause the cam arms to be vertically reciprocated or moved in an out-of-phase relationship, such as indicated in FIGS. 3A and 3B, whereby each of the rocker arms can be pivoted out of a substantially planar alignment, resulting in a variation in the amount of length of travel of the rocker arms and push rods, and correspondingly an adjustment or change in the amount of stroke or vertical movement of the needle bar(s). For example, to adjust the depth of penetration or otherwise increase the amount or length of stroke of the needles through the backing material, the position of the cam arms can adjusted by varying the rates at which the drive motors drive their primary driveshafts, which accordingly will vary or change the rate of rotation of each associated set or pair of first and second drive members so as to change the orientation of each rocker arm and thus the timing and amount of vertical movement imparted to the push rods.

The stroke of the needle bar(s) can be adjusted as needed to vary the upstroke or down stroke of the needle bar(s) such as for adjusting or changing between different style or pile heights of the tufted articles being produced. In addition, the variable stroke drive system enables the adjustment of the needle bar stroke during individual tuft or stitch cycles of the tufting machine to enable a desired deeper penetration of the needles, if needed, and/or alternatively to provide a longer dwell or delay time on the upstroke of the needle bar(s) so that the needles remain out of the backing material for a longer time such as while the needle bars are shifted to enable a desired shift distance, i.e., double or triple gauge shifts or jumps or greater, without interference with or engagement of the needles by the backing material.

Accordingly, the variable needle bar stroke system 10 enables controlled adjustment or variation of the stroke of the needles, including adjustment of the stroke on-the-fly, or otherwise during individual tuft operations or stitch formation. Such adjustments can provide for formation of tufts having different or varied pile heights at desired locations or areas of the pattern being formed, enabling formation of sculpted and various other pattern effects to be formed as needed or desired and with increased precision and/or consistency. Additionally, the variable control of the needle bar stroke further can enable variations in the amount or length of the shifting or stepping of the needle bar and/or length or depth of penetration of the needles without substantially reducing or delaying the production of the tufting machine.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention.

It further will be understood that the disclosed invention is not limited to the particular methodology, devices, apparatus, materials, applications, etc., described herein, as these may vary. It is also to be understood that the terminology used herein is used for the purpose of describing particular embodiments only, and is not intended to limit the scope of the invention. It must be noted that as used herein and in the appended claims, the singular forms "a," "an," and "the" include plural references unless the context clearly dictates otherwise.

Unless defined otherwise, all technical and scientific terms used herein have the same meanings as commonly understood by one of ordinary skill in the art in the field to which this invention is directed, and it will be understood that any methods and materials similar or equivalent to those described herein can be used in the practice or construction of the invention.

Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

What is claimed is:

1. A variable drive system for driving a needle bar of a tufting machine in a reciprocating motion, comprising:

a pair of motors each connected to a drive shaft, and each linked to a control system so as to receive control instructions and/or provide feedback thereto; and a plurality of drive assemblies mounted in spaced series across the tufting machine frame, each drive assembly comprising:

a pair of first drive members each linked to one of the drive shafts of one of the motors such that each of the first drive members is driven by operation of one of the motors;

a pair of second drive members each linked to an associated one of the first drive members so as to be driven thereby;

a series of cam arms, each cam arm having a proximal end coupled to one of the second drive members and a distal end spaced therefrom;

a rocker arm extending between the cam arms; and a push rod having a proximal end attached to the rocker arm at a location intermediate the ends of the rocker arm, the push rod linked to the needle bar of the tufting machine for moving the needle bar along a selected stroke;

wherein as the motors drive the first drive members, the cam arms are moved in a substantially reciprocating motion for driving the push rods and the needle bar linked thereto along its stroke in a substantially reciprocating movement, and wherein the motors each are operable at varying rates in response to control instructions received to offset and/or vary the movement of each cam arm of each of the drive assemblies so as to adjust the stroke of the needle bar.

2. The variable drive system of claim 1, further comprising drive belts or chains linking each first drive member to the associated one of the second drive members.

3. The variable drive system of claim 1, wherein the proximal ends of the cam arms are each mounted to the second drive members at an off-center location.

4. The variable drive system of claim 1, wherein the motors comprise variable speed drive motors.

5. The variable drive system of claim 4, wherein each drive shaft extends substantially across a width of the tufting machine.

6. The variable drive system of claim 4, wherein the drive shafts each comprise a plurality of drive shafts connected in series across a width of the tufting machine.

7. A method of operating a tufting machine to form tufted articles, comprising:

moving a backing material through the tufting machine;

reciprocating at least one needle bar carrying a series of spaced needles therealong toward and away from the backing material with a plurality of drive assemblies, each drive assembly comprising a series of drive gears, a pair of cam arms, each cam arm connected to one of the drive gears of the series of drive gears so as to be moved in a substantially linear reciprocating motion by the rotation of the drive gears, a rocker arm extending between and moving with cam arms, and a push rod pivotally mounted along an intermediate portion of the rocker arm and connected to the needle bar for imparting the substantially linear reciprocating motion of the cam arms thereto;

feeding a series of yarns to the needles arranged along the needle bar for forming a series of tufts in the backing material;

varying timing and/or a rate at which selected ones of the drive gears are rotated as needed to vary an amount of reciprocating movement of the needle bar in accordance with pattern instructions for the tufted article; and in response to varying the timing and/or rate of rotation the selected ones of the drive gears, reorienting the rocker arms of the drive assemblies with respect to the pusher rods mounted thereto so as to adjust a stroke of the needle bar.

8. The method of claim 7, wherein varying the rate at which selected ones of the series of drive gears are rotated comprises operating drive motors coupled to a first drive gear of the drive gears at different rates.

9. The method of claim 7, wherein varying the rate at which selected ones of the drive gears are rotated further comprises adjusting the rate of rotation of the selected ones of drive gears during a stitch cycle to adjust a dwell time of the needles.

10. The method of claim 7, further comprising shifting the at least one needle bar in a direction transverse to the movement of the backing material through the tufting zone.

11. The method of claim 7, further comprising varying the feeding of at least selected ones of the yarns to the needles so as to pull the yarns low or out of the backing material.

12. The method of claim 7, wherein reorienting the rocker arms comprises driving the cam arms of each pair of cam arms between which the rocker arms are mounted in an out-of-phase relationship to cause pivoting of the rocker arms with respect to the push rods.

13. The method of claim 7, further comprising engaging the needles with a series of loop pile loopers, cut pile hooks or level cut loop loopers as the needles are reciprocated into the backing material to form a series of loop and/or cut pile tufts.

14. A tufting machine, comprising:

a frame;

a tufting zone defined along the frame and through which a backing material is fed;

a needle bar reciprocable toward and away from the backing material and having a series of spaced needles therealong for forming tufts of yarns in the backing material;

a needle bar drive system mounted along the frame of the tufting machine and comprising at least one drive assembly with a series of drive motors coupled thereto, the at least one drive assembly comprising:

a pair of first drive members each independently driven by at least one of the drive motors;

a pair of second drive members, each linked to one of the first drive members so as to be correspondingly driven in response to the driving of the first drive members by the drive motors;

cam arms mounted to each of the second drive members and each movable in a substantially linear motion in response to the driving of the second drive members;

a rocker arm mounted between the cam arms so as to move with the cam arms; and a push rod coupled to the rocker arm and to the needle bar, whereby the substantially linear movement of the cam arms is imparted to the needle bar so as to move the needle bar in a reciprocating motion along a stroke of a selected length; and a tufting machine control system in communication with the drive motors to provide control instructions thereto;

wherein, in response to a change in control instructions, at least one drive motor varies rotation of at least one of the first drive members so as to cause the substantially linear motion of a selected one of the cam arms to be varied with respect to the other cam arm, sufficient to reorient the rocker arm with respect to the push rod coupled thereto to adjust the length of the stroke of the needle bar.

15. The tufting machine of claim 14, further comprising drive belts or chains linking each first drive member to a corresponding one of the second drive members.

16. The tufting machine of claim 14, wherein the proximal ends of the cam arms are each mounted to the second drive members at an off-center location.

17. The tufting machine of claim 14, further comprising a series of drive assemblies mounted in spaced series across the frame of the tufting machine.

18. The tufting machine of claim 17, wherein the drive motors comprise at least two independent controlled variable speed motors.

19. The tufting machine of claim 17, wherein the drive motors comprise at least 4 variable speed motors, coupled to each of the drive assemblies by a series of connected drive shafts.

20. The tufting machine of claim 14, further comprising a yarn feed mechanism for selectively controlling feeding yarns to the needles of the needle bar for forming tufts of yarns in the backing material as the needles are reciprocated into engagement with the backing material.

* * * * *